United States Patent [19]

Sisk

[11] 4,191,026

[45] Mar. 4, 1980

[54] APPARATUS FOR DEFROSTING LOW TEMPERATURE HEAT EXCHANGER

[75] Inventor: Francis J. Sisk, Apollo, Pa.

[73] Assignee: Electric Power Research Institute, Inc., Palo Alto, Calif.

[21] Appl. No.: 768,451

[22] Filed: Feb. 14, 1977

[51] Int. Cl.[2] ..... F25D 21/02

[52] U.S. Cl. ..... 62/140; 62/276; 340/580

[58] Field of Search ..... 62/140, 151, 276; 55/274, 212; 340/580; 73/204

[56] References Cited

U.S. PATENT DOCUMENTS

| | | | |
|---|---|---|---|
| 2,728,225 | 12/1955 | Skibitzke | 73/204 |
| 2,786,354 | 3/1957 | Martin et al. | 73/204 |
| 3,355,904 | 12/1967 | Sutton, Jr. et al. | 62/151 |
| 3,623,334 | 11/1971 | Heidorn | 62/140 |
| 3,643,457 | 2/1972 | Winkler | 62/140 |

*Primary Examiner*—William E. Wayner

*Attorney, Agent, or Firm*—Townsend and Townsend

[57] ABSTRACT

An evaporator heat exchanger is disposed within a vertical, rectangular duct. A heater for defrosting the heat exchanger is disposed beneath the exchanger. During the defrost cycle heated air rises by convection vertically through the heat exchanger. The defrost cycle is initiated by sensing the pressure drop across the heat exchanger. This is done by extending a small diameter pipe through a wall of the duct downstream of the heat exchanger so that an air current is drawn through the pipe during normal operation of the system. A constant energy output heater heats the air current in the pipe so that the temperature of the heated current remains constant so long as the air volume flowing in the pipe remains constant. As the pressure drop across the heat exchanger increases as a result of an increasing frost buildup, relatively more air is drawn through the pipe. As a result the temperature of the heated air in the pipe decreases. A control switch is adjusted so that it initiates the defrost cycle whenever the air current temperature reduction in the pipe reaches a predetermined value.

15 Claims, 1 Drawing Figure

APPARATUS FOR DEFROSTING LOW TEMPERATURE HEAT EXCHANGER

BACKGROUND OF THE DISCLOSURE

A heat pump system generally comprises a compressor unit and a heat exchange system including a relatively low temperature evaporator and a relatively high temperature condenser. Frequently, the compressor and the evaporator heat exchanger are combined in a unit, the compressor being generally disposed interiorly of the cooling coils of the evaporator so that air cooled by the evaporator can be used to cool the compressor. Recent studies have shown that for a variety of reasons such an arrangement is wasteful of energy. As a result, it has been suggested to separate the compressor from the evaporator, installing the former indoors and the latter outdoors to minimize heat losses during cold weather.

During operation of the heat pump, there is frequently a buildup of frost or ice on the heat exchanger coils of the evaporator. The amount of ice that forms is a function of the ambient temperature and the relative humidity, the buildup being greatest at temperatures around 0° C. and at a saturated humidity. Since the frost buildup impedes the airflow past the heat exchanger, the unit must be defrosted periodically. In the past, the defrosting cycle was normally initiated at predetermined time intervals. Of course, the time intervals had to be chosen to effect adequate defrosting when the frost buildup is at a maximum. Consequently, during other temperature and humidity conditions, when the frost buildup is less the system defrosts too frequently. This resulted in a significant waste of energy.

Attempts have also been made in the past to initiate defrost cycles by sensing the change in the pressure drop across the heat exchanger. With a buildup of frost the pressure on the downstream side of the heat exchanger decreases. This decrease is sensed with a differential barometric pressure switch. The difficulty with such an arrangement is that the differential pressure switch must close contacts reliably on pressure changes in the order of as little as 1/50th inch W.G. Up to the present it has been difficult or impossible to make such sensitive pressure switches, at least on an economically feasible basis.

Aside from problems of determining the initiation (and termination) of defrost cycles, prior art heat pump systems were less than fully satisfactory as far as the performance of the actual defrost cycle is concerned. Normally, prior art heat exchangers are constructed so that air flows through them along an essentially horizontal path. Unless previously heated air is uniformly heated and well mixed, there are significant temperature differentials between the upper and lower portion of the horizontal path leading to unequal defrost times, local overheating, and the like, all of which is undesirable. As a consequence, defrosting systems have commonly been chosen which heat the frosted coil internally by reversing the refrigeration cycle. Such operation, with a warm evaporator and cold condenser, generates abrupt pressure reductions in the system low side, a low refrigerant flow and a high probability of inefficient cooling and lubrication of the hermetically sealed motor-compressor and, therefore, an increased compressor failure rate.

SUMMARY OF THE INVENTION

The present invention provides an efficient and reliable system for defrosting heat exchangers of heat pumps. The heat exchanger is mounted within an upright air duct fitted at its downstream end with a draw-through or suction fan to draw air vertically upward through the heat exchanger. The heat exchanger itself is mounted so that the air flows vertically past it. A defrost heater is positioned in the duct beneath an upstream end of the heat exchanger. The heater can be an electric resistance heater such as are commercially available under the trade designation CALROD in which electric resistance wires are insulated with magnesium oxide and disposed within flat metal tubes. This heater substantially evenly heats the air beneath the heat exchanger so that the air rises by convection upwardly through the exchanger during a defrost cycle. The heretofore common, relatively complicated and expensive reverse cycle defrost systems can be replaced with rugged, low cost, simple to install electric resistance heaters.

The defrost cycle is initiated by sensing the pressure drop across the heat exchanger which, as is above summarized, increases as the frost builds up. The pressure drop, however, is not directly sensed to avoid the above-discussed difficulties encountered with conventional barometric differential pressure sensors.

Instead, the present invention provides a relatively small diameter bypass pipe which extends through the air duct and terminates downstream of the heat exchanger. As a result, during normal operation of the fan an auxiliary air current is drawn through the pipe into the section between the coil and the fan duct. As long as there is no frost buildup on the heat exchanger and, therefore, no change in the pressure drop across it, the volume of air flowing through the pipe remains constant.

A constant energy output heater is placed inside the pipe to heat the auxiliary air current. As long as the amount of air flowing through the pipe remains constant, its temperature rise remains also constant. If there is a buildup of frost on the heat exchanger and a resulting increased pressure drop across it, the volume of air flowing through the pipe will increase correspondingly. As a result, the temperature of the heated air will decrease. This decrease in the heated air temperature rise is reliably and inexpensively sensed and used to initiate a defrost cycle.

For this purpose, a temperature sensor is mounted in the pipe downstream of the heater and coupled with a differential temperature switch which gets a second, relatively constant reading from another temperature sensor disposed outside the conduit or inside the conduit where the temperature of air flowing past the heat exchanger remains substantially constant. If a predetermined temperature drop in the auxiliary air current has been determined, the switch is closed which energizes the resistance heater while it deactivates the compressor, the suction fan and the constant energy output heater inside the pipe. The defrost cycle continues until completed as determined, for example, by measuring the temperature of the airflow through the heat exchanger or by measuring the temperature of the heat exchanger itself. The defrost cycle is simply terminated by again opening the differential temperature switch and operating the system as above-described until the next defrost cycle is required.

It is apparent that the defrost cycle initiator of the present invention eliminates the heretofore common energy wasting fixed time interval defrost cycle. Also, it eliminates the unreliable and sometimes dangerous low pressure differential switches. Instead, the present invention indirectly senses the pressure drop across the heat exchanger in a simple, inexpensive, highly sensitive and completely reliable manner. Thus, it assures both better performance of the heat pump and a reduced overall energy consumption.

DESCRIPTION OF THE PREFERRED EMBODIMENTS

Figure 1:
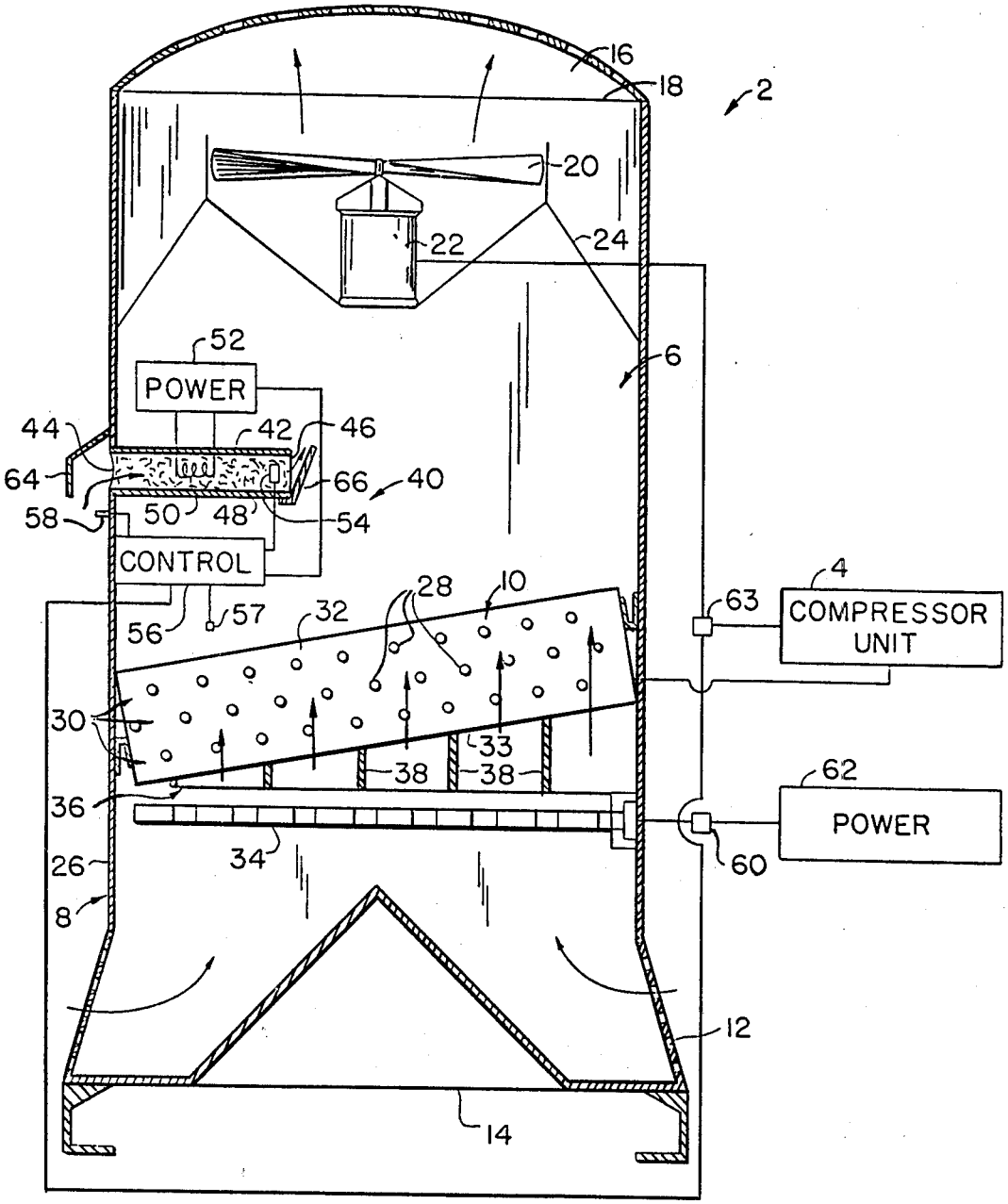
FIG. 1 is an upright, schematic illustration of a heat pump constructed in accordance with the present invention and in particular it illustrates the construction of the heat exchanger, its relative positioning in a surrounding air duct, and the construction of the defrost initiator.

Referring to the drawing, heat pump 2 generally comprises a compressor unit 4 shown mounted separately of and spaced apart from an evaporator heat exchanger 10 and a defrost system 6 therefor. Other conventional heat pump components such as a condenser or an expansion valve are also provided. For simplicity, they are neither separately shown nor described herein. Generally speaking, the defrost system comprises an upright air duct 8 surrounding heat exchanger 10 and having an air intake 12 adjacent a base 14 and an air exhaust 16 at a top 18 of the duct. Normally, the heat exchanger has a rectangular (which for the purposes of this application includes a "square") plan configuration and the air duct has a complimentary cross-section.

A suction fan 20 driven by a motor 22 is coaxially mounted within the duct adjacent the top thereof and is supported by a suitable mounting structure 24 which in turn is carried by upright side walls 26 of the duct. During normal operation, the fan draws air through duct air intake 12 and the air rises upwardly in a vertical direction past heat exchanger 10 and is then exhausted.

As was mentioned above, frost frequently forms on the heat exchanger. The amount of frost buildup is a function of the ambient temperature and humidity, and it is largest at temperatures in the vicinity of about 0° C. and at a saturated humidity. As the frost builds up on the heat exchanger, it impedes the passage of air and the heat transfer between the air and the heat exchanger. Consequently, the heat exchanger must be periodically defrosted, and it is the purpose of the present invention to facilitate the defrosting cycle and to render it less wasteful of valuable energy.

The heat exchanger 10 comprises multiple, horizontally oriented heat exchanger coils or conduits 28 which are arranged in a plurality, e.g. three parallel coil layers 30. A multiplicity of spaced apart, parallel heat exchange fins are thermally coupled, e.g. brazed to the exterior of each coil 28 and arranged so that air can flow in a vertical direction past the fins and the coils as is indicated in the drawing by the vertical arrows leading through the heat exchangers. For simplicity, the fins are not individually shown but are only schematically illustrated in the drawing by a generally rectangular box having an outline corresponding to the combined outline of all fins attached to all coils. The individual fins have a rectangular or square shape.

The coil layers 30 are horizontally arranged or slightly inclined relative to the horizontal by an angle not exceeding approximately 10°. It is preferred that the edges 33 of the fins be parallel to the coil layers 30 since such an inclination of the edges facilitates the drainage of water during a defrost cycle.

Mounted beneath, that is upstream of the heat exchanger 10 is an electric resistance heater 34, constructed as above described and secured to the duct side wall 26 in a conventional manner. During a defrost cycle, the resistance heater is energized so that heated air rises by convection upwardly through the spaces between heat exchange fins 32 to melt ice that has formed on the fins and on the coils. In instances in which the coil layers are inclined to the horizontal (as shown in the drawing) an airflow control baffle 36 is provided to assure that the air flows uniformly to all portions of the heat exchanger. The baffle comprises multiple, parallel, upright walls 38 which columnize convection airflow. A more efficient, complete and uniform defrosting of the heat exchanger is thereby obtained.

To control, that is to start and terminate the defrost cycles the present invention provides a defrost cycle initiator 40 which generally comprises an auxiliary air current pipe 42 of a relatively small, e.g. ¾ inch diameter. The pipe extends through duct side walls 26 and has an intake 44 disposed outside the duct and an outlet 46 disposed inside the duct at a downstream duct portion located between the heat exchanger 10 and fan 20. A flow resisting packing such as stainless steel wool 48 or multiple baffles are placed in the pipe to control the airflow therethrough. For example, the density and depth of the stainless steel wool can be adjusted to produce an auxiliary air current flow of 1.0 CFM during normal operation, that is with fan 20 running and little or no frost buildup on coils 28 and cooling fins 32.

A constant energy output heater 50 energized via a power source 52 is disposed within pipe 42 for heating the air current therethrough. It is apparent that as long as the volume of air (per unit time) remains constant, the heater raises the temperature of the air current by a constant value. If the volume of air flowing through the pipe changes, however, the temperature of the heated air rises or decreases depending on whether or not the volume is smaller or larger. For the above-discussed example in which the pipe packing is adjusted so as to yield a normal 1.0 CFM airflow therethrough, the provision of a heater having a constant energy output of 10 watts leads to a temperature increase of the air flowing through the pipe of approximately 25° F.

A first temperature sensor 54 is disposed within pipe 42 downstream of heater 50 and is operatively connected with a control 56 that includes a main switch. The switch is preferably a differential temperature switch (of an electrical or mechanical construction) and is coupled with a second temperature sensor 58 shown mounted exteriorly of the duct to measure the temperature of the ambient air. Alternatively, the second temperature sensor may be mounted interiorly of the duct (but upstream of the pipe 42) to measure the temperature of air flowing through the duct. For practical purposes, the temperature of this air fluctuates with ambient air temperature fluctuations.

Switch 56 in turn controls a defrost relay 60 so that resistance heater 34 is connected with a power supply 62 to thereby initiate the defrost cycle. Switch 56 at the same time operates a main control relay 63 to shut down the heat pump during the defrost cycle, e.g. to shut down compressor 4 and fan 22. Lastly, switch 56 also de-energizes constant energy output heater 50 during the defrost cycle.

In operation and with heat exchanger 10 completely or substantially defrosted approximately 1.0 CFM of air is drawn through pipe 42. This air is heated approximately 25° above the ambient temperature. Switch 56 is set so that resistance heater 34 is de-energized and fan motor 22 is operating at that auxiliary air temperature. As frost builds up between coils 28 and fins 32, the pressure drop across the heat exchanger increases. As a result, the pressure in the downstream portion of duct 8 between the heat exchanger and fan 20 decreases slightly which in turn increases the volume (per unit time) of air flowing through pipe 42.

The increased air volume flowing therethrough causes a corresponding decrease of its temperature rise. Switch 56 is set so that it operates when there is a predetermined reduction in the temperature rise of the heated air flowing through the pipe 42.

I claim:

1. A heat exchanger defrosting system comprising in combination: a heat exchanger; an air duct surrounding the heat exchanger for flowing air through the duct past the exchanger; means in fluid communication with a portion of the duct downstream of the heat exchanger for inducing the airflow through the duct and past the exchanger; a relatively small cross-section conduit having an intake disposed outside the downstream duct portion and an outlet disposed inside the downstream duct portion; whereby the flow inducing means also induces the flow of an air current in the conduit; a constant energy output heater for heating the air current; a first temperature sensor disposed within the conduit between the heater and the downstream portion of the duct for sensing the temperature of the heated air current; and initiator means responsive to the temperature sensor for initiating a defrost cycle for the heat exchanger in response to a predetermined decrease in the temperature of the heated air current; whereby a reduction in the airflow past the exchanger causes the airflow inducing means to increase the amount of air flowing through the conduit and thereby causes a corresponding reduction in the air current temperature and the initiation of the defrost cycle in response to a predetermined frost buildup on the heat exchanger.

2. A system according to claim 1 wherein the intake of the conduit is disposed exteriorly of the duct for the intake into the conduit of ambient air.

3. A system according to claim 1 including a flow reducing packing in the conduit for limiting the normal flow of the air current through the conduit to a predetermined amount.

4. A system according to claim 3 wherein the packing is selected to limit the flow of air current in the conduit to about one cubic foot per minute under normal operating conditions in which there is substantially no frost buildup in the heat exchanger.

5. A system according to claim 1 wherein the heater is mounted interiorly of the conduit.

6. A system according to claim 1 wherein the initiator means comprises a second temperature sensor for sensing the temperature of one of the ambient air and of the airflow in the duct downstream of the heat exchanger and upstream of the conduit outlet; and means for starting the defrost cycle when the temperature rise of the heated air current has been reduced by about 50% over the temperature rise encountered when the heat exchanger is substantially frost-free.

7. A heat exchanger defrosting system comprising in combination: a heat exchanger; an air duct surrounding the heat exchanger for flowing air through the duct past the exchanger; means in fluid communication with a portion of the duct downstream of the heat exchanger for inducing the airflow through the duct and past the exchanger; a relatively small diameter pipe disposed downstream of the heat exchanger and upstream of the inducing means and protruding through the duct so as to establish fluid communication between the duct exterior and the downstream duct portion; whereby the inducing means causes the formation of an ambient air current in the pipe; a constant energy output heater disposed in the pipe for heating the air current; whereby the temperature of the heated current is a function of the volume of ambient air flowing through the pipe; a temperature sensor for the heated air current; differential switch means operatively coupled with the temperature sensor for actuating the switch means to place it from a normal operating mode into a defrost mode when the sensor senses that the temperature of the air current has been reduced by a predetermined amount; means operatively coupled with the switch means for initiating a heat exchanger defrost cycle when the switch means is in its defrost mode; and defrost cycle terminating means for actuating the switch means after completion of the defrost cycle to return the switch means to its normal operating mode.

8. A system according to claim 7 wherein the switch means comprises a differential temperature switch, and including another temperature sensor for sensing the temperature of a relatively constant temperature volume of air.

9. A system according to claim 8 wherein the second sensor senses the temperature of ambient air.

10. A system according to claim 7 wherein the terminating means comprises a temperature sensor operatively coupled with the switch means for actuating the switch means in response to a predetermined absolute temperature of one of the heat exchangers and air passing through the heat exchanger.

11. A system according to claim 7 wherein the duct is an upright duct and the heat exchanger is disposed within the duct and constructed for flowing air vertically past it; and including an electrical resistance heater disposed vertically beneath the heat exchanger for heating air during the defrost cycle so that such heated air rises past and defrosts the heat exchanger; and including means for deactivating the airflow inducing means and for energizing the resistance heater when the switch means is in its defrost mode.

12. A system according to claim 11 including for deactivating the heater in the pipe when the switch means is in its defrost mode, and for re-energizing the heater in the pipe in response to a return of the switch means from its defrost mode to its normal mode.

13. A heat pump defrost system having an outdoor heat exchange unit and a compressor unit spaced apart from the heat exchange unit, the heat exchange unit comprising in combination: an upright air duct having a substantially rectangular cross-section; an electrical resistance heater disposed within a lower portion of the air duct; a heat exchanger assembly defined by a plurality of substantially horizontally oriented refrigerant conduits, each conduit being fitted with a multiplicity of thermally coupled, vertically disposed heat exchange fins, the conduits and the fins being arranged within the air duct and disposed vertically above the resistance heater; whereby during a defrost cycle air heated by the heater rises by convection upwardly from the heater and substantially vertically through the heat exchanger to effect the defrosting of the conduits and the fins; means for initiating the defrost cycle comprising means for flowing an auxiliary air current at a point downstream of the heat exchanger from the exterior of the duct to the interior thereof; means for sensing a change in the auxiliary current caused by the formation of frost on the heat exchanger; and means for activating the heater in response to sensing a predetermined change in the auxiliary current.

14. A system according to claim 13 wherein the sensing means comprises heater means disposed in the auxiliary current and having a constant energy output, and temperature sensing means for determining a temperature change in the auxiliary current due to variations in the volume of air flowing in the auxiliary current.

15. Apparatus for initiating a defrost cycle for a heat exchanger comprising: an air duct surrounding a heat exchange coil assembly; means for inducing an airflow through the duct; bypass conduit means for flowing an air current bypassing the coil assembly in the direction of the airflow, the bypass conduit means terminating in the duct downstream of the coil assembly; a constant energy output heater disposed within the conduit for heating the bypass air current; first temperature sensing means for sensing the temperature of the heated bypass air current so that a temperature reduction of the heated air current caused by an increased air current volume flowing through the conduit means can be sensed; second temperature sensing means for sensing the temperature of a reference medium exterior of the duct; and means for initiating a coil assembly defrost cycle in response to sensing a predetermined differential in the temperatures sensed by the first and second temperature sensing means.

* * * * *